US009611653B2

(12) United States Patent
Martin et al.

(10) Patent No.: US 9,611,653 B2
(45) Date of Patent: Apr. 4, 2017

(54) SIDING OR ROOFING PANEL SYSTEM

(71) Applicant: Tapco International Corporation, Wixom, MI (US)

(72) Inventors: Jeffrey B. Martin, Newton, CT (US); James C. Parks, Carlisle, OH (US); Matthew M. Jackson, Saline, MI (US); Richard C. Kruyer, Swartz Creek, MI (US); Michael W. Maurer, Walled Lake, MI (US); Daniel B. Franklin, Monroe, OH (US)

(73) Assignee: Tapco International Corporation, Wixom, MI (US)

( * ) Notice: Subject to any disclaimer, the term of this patent is extended or adjusted under 35 U.S.C. 154(b) by 0 days.

(21) Appl. No.: 14/991,250

(22) Filed: Jan. 8, 2016

(65) Prior Publication Data

US 2016/0208498 A1 Jul. 21, 2016

Related U.S. Application Data

(60) Provisional application No. 62/104,978, filed on Jan. 19, 2015.

(51) Int. Cl.

| | |
|---|---|
| ***E04B 1/38*** | (2006.01) |
| ***E04F 13/08*** | (2006.01) |
| ***E04D 1/26*** | (2006.01) |
| ***E04F 13/18*** | (2006.01) |

(52) U.S. Cl.

CPC ..... *E04F 13/0864* (2013.01); *E04D 1/265* (2013.01); *E04F 13/0846* (2013.01); *E04F 13/0894* (2013.01); *E04F 13/185* (2013.01)

(58) Field of Classification Search

CPC ..... E04F 13/0864; E04F 13/0873; E04F 13/0894; E04D 1/265

See application file for complete search history.

(56) References Cited

U.S. PATENT DOCUMENTS

| | | | | |
|---|---|---|---|---|
| 2009/0282751 | A1* | 11/2009 | Orfield | B29C 47/0066 52/105 |
| 2012/0174495 | A1* | 7/2012 | Nolan | E04F 19/045 52/58 |
| 2014/0202106 | A1* | 7/2014 | Wagner | E04F 13/0837 52/520 |

* cited by examiner

*Primary Examiner* — Patrick Maestri
(74) *Attorney, Agent, or Firm* — Quinn IP Law

(57) ABSTRACT

A panel for attachment to a mounting surface includes a plurality of raised faces formed and extending between an upper edge and a lower edge of the panel, and a plurality of recessed keyways defined between each of the raised faces. The panel may have a recessed base at the lower edge of the keyways defining a fold lip adjacent the mounting surface, and a full base formed at the lower edge of the raised faces and extending beyond the recessed base. The fold lip provides a reaction point for an under lap extending from the lower edge toward the upper edge. The panel may include a lock flange formed at the upper edge. The lock flange defines a lock slot between layers of the panel, and closes the lock slot to substantially zero depth at a first touch point and a second touch point.

13 Claims, 5 Drawing Sheets

SIDING OR ROOFING PANEL SYSTEM

CROSS-REFERENCE TO RELATED APPLICATIONS

This application claims the benefit of U.S. Provisional Application No. 62/104,978, filed Jan. 19, 2015, which is hereby incorporated by reference in its entirety.

TECHNICAL FIELD

This disclosure relates to siding or roofing panel systems for attachment to mounting surfaces.

BACKGROUND

Exterior siding or roofing systems may include a plurality of panels, with each of the panels formed to simulate a plurality of individual decorative units. For example, each panel may emulate a plurality of wooden shakes or shingles, such that each decorative unit is formed to simulate a single shake or shingle. Furthermore, the decorative units may be formed to simulate other siding materials, including stone, tile, et cetera.

SUMMARY

A panel configured for attachment to a mounting surface is provided. The panel includes a plurality of raised faces formed and extending between an upper edge and a lower edge of the panel, and a plurality of recessed keyways defined between each of the raised faces. The raised faces and the keyways define a plurality of elements spaced at an average element distance.

The panel may have a recessed base formed at the lower edge of the keyways, such that the recessed base defines a fold lip adjacent the mounting surface, and a full base formed at the lower edge of the raised faces. The full base extends further than the recessed base. An under lap extends from the lower edge toward the upper edge adjacent to the mounting surface when the panel is attached thereto. The fold lip is configured to provide a reaction point for the under lap.

The panel may also include a lock flange formed at the upper edge. The lock flange defines a lock slot between layers of the panel, and closes the lock slot to substantially zero depth at a first touch point and a second touch point.

The above features and advantages, and other features and advantages, of the present invention are readily apparent from the following detailed description of some of the best modes and other embodiments for carrying out the invention, which is defined solely by the appended claims, when taken in connection with the accompanying drawings.

DETAILED DESCRIPTION

Figure 4:
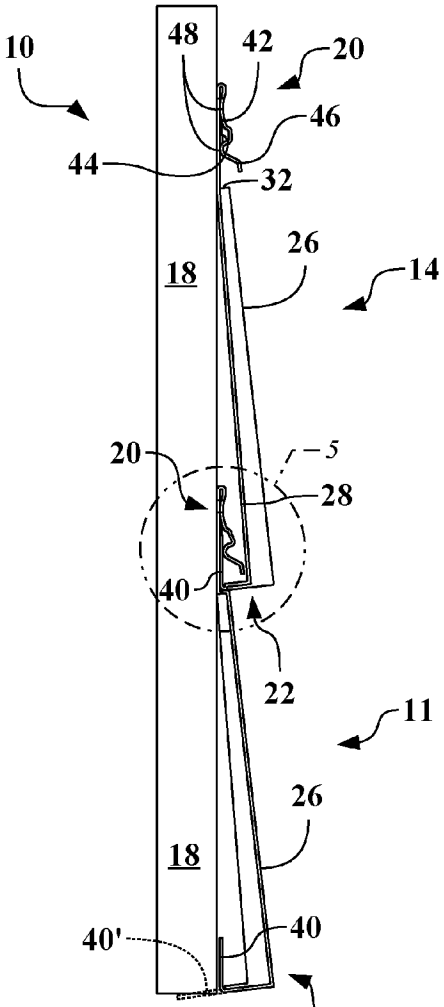
FIG. 4 is a schematic cross-sectional view taken generally along line 4-4 of FIG. 2.

Referring to the drawings, like reference numbers correspond to like or similar components wherever possible throughout the several figures. There is shown in FIG. 1 an isometric view of a portion of a siding system 10 and in FIG. 2 a partial front view of the siding system 10.

Figure 1:
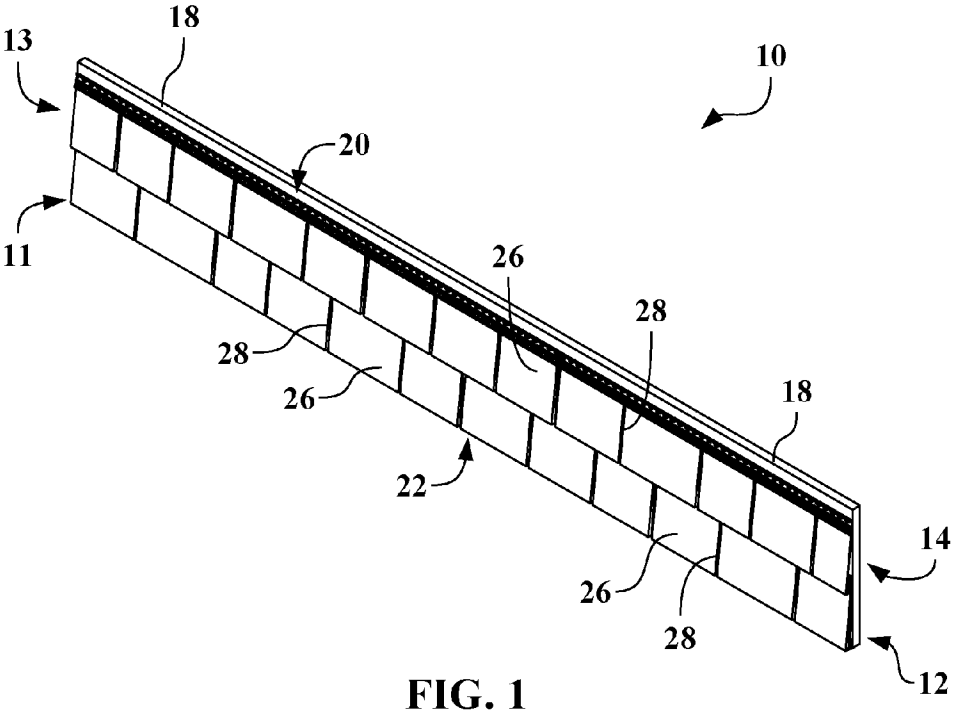
FIG. 1 is a schematic isometric view of a portion of a siding system having a plurality of panels.
Figure 2:
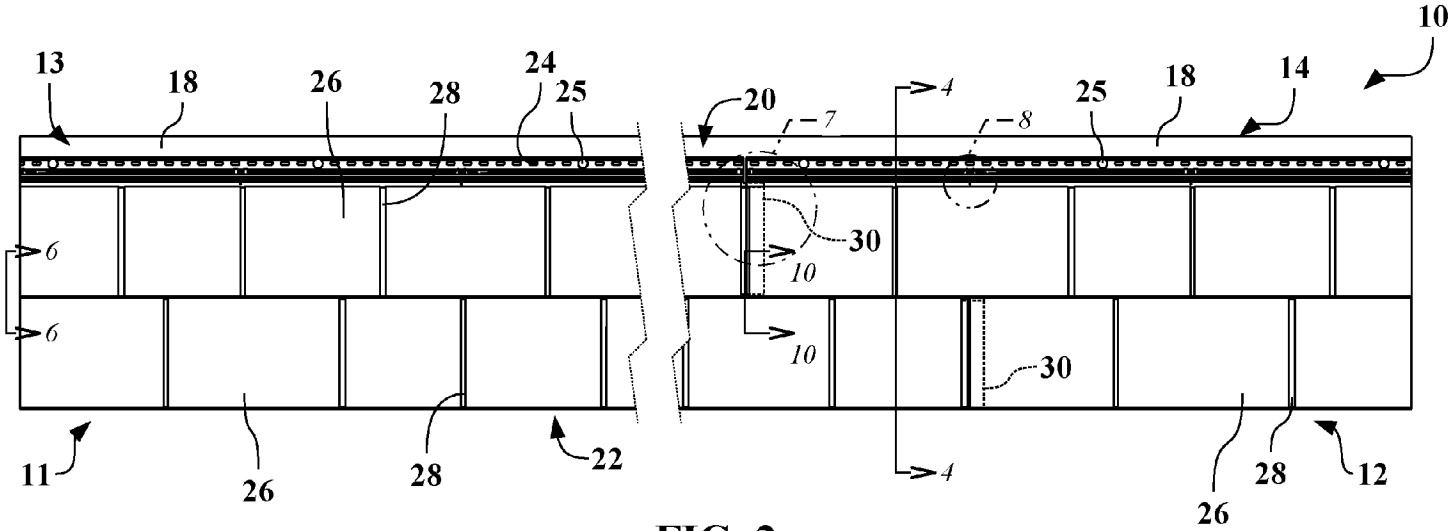
FIG. 2 is a schematic plan view of the siding system of FIG. 1.

The siding system 10 illustrated in FIGS. 1 and 2 includes a first panel 11, a second panel 12, a third panel 13, and a fourth panel 14. The second panel 12, the third panel 13, and the fourth panel 14 have similar features to the first panel 11, such that they may be referred to collectively or generically as panels 16.

The panels 16 are configured for attachment to a mounting surface 18, only a portion of which is shown in the figures. In FIGS. 1 and 2, the mounting surface 18 is a substantially vertical structure, such as an exterior wall or insulating materials attached thereto. However, the siding system 10 may alternatively be attached to roofs or angled walls, such that the mounting surface 18 may be an angled wall or a roof surface.

Each of the panels 16 is formed from a substrate material having substantially-constant thickness. The rearward sides of the panels 16 define a mounting plane, particularly when assembled to each other, which may be substantially coincident with the mounting surface 18.

While the present invention may be described with respect to specific applications or industries, those skilled in the art will recognize the broader applicability of the invention. Those having ordinary skill in the art will recognize that terms such as "above," "below," "upward," "downward," et cetera, are used descriptively of the figures, and do not represent limitations on the scope of the invention, as defined by the appended claims. Any numerical designations, such as "first" or "second" are illustrative only and are not intended to limit scope in any way.

As used herein, substantially equal refers to quantities, values, or dimensions that are within manufacturing variance or tolerance ranges of being perfectly equal. Substantially equal dimensions, for example, may be planned as ideally equal but normal manufacturing tolerances may cause the resulting dimensions to vary by 10-20% for different pieces.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

Figure 3:
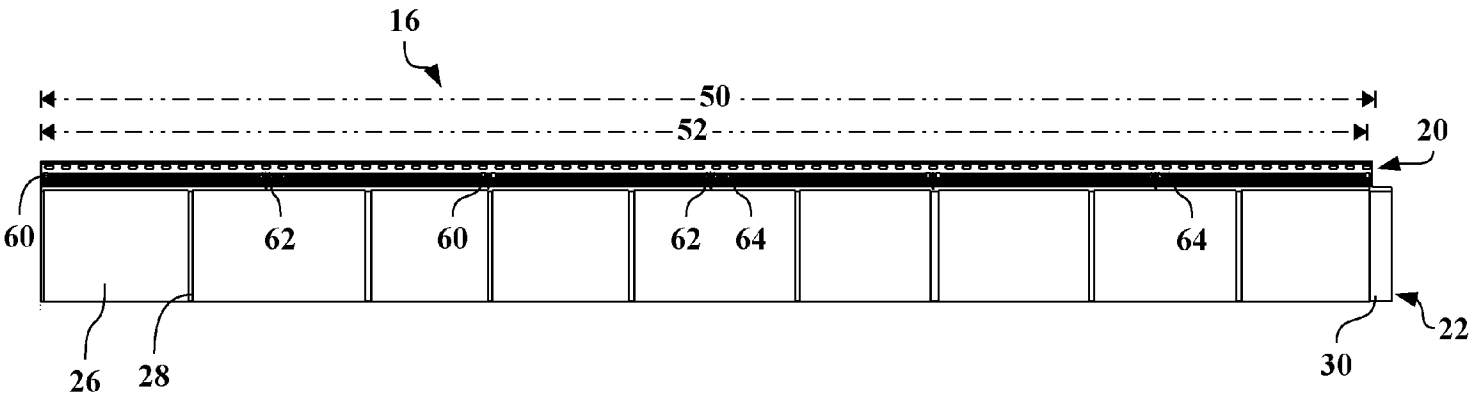
FIG. 3 is a schematic plan view of one of the panels of the siding system shown in FIGS. 1-2.

Referring also to FIG. 3 and to FIG. 4, and with continued reference to FIGS. 1 and 2, there are shown additional views of portions of the siding system 10. FIG. 3 shows a schematic front view of one of the panels 16 for the siding system 10, and FIG. 4 shows a schematic cross-sectional view of the siding system 10 taken generally along a section line 4-4 shown in FIG. 2. The panel 16 shown in FIG. 3 may be substantially identical to the first panel 11.

Features of the panels 16 will be described interchangeably with reference to all of FIGS. 1-4, and may refer to any of the first panel 11, the second panel 12, the third panel 13, and the fourth panel 14. Note that manufacturing variance may lead to natural differences between panels 16 that are, otherwise, intended to be identical.

The panels 16 may be formed from different types of plastic or composite materials. For example, and without limitation, the panels 16 may be formed from vinyl, polypropylene, PVC, combinations of similar materials, et cetera. Furthermore, the panels 16 may be formed as unitary, one-piece components, such that each of the first panel 11, the second panel 12, the third panel 13, and the fourth panel 14 is a single component formed from a single piece of material (a single substrate), without subsequent attachment of pieces formed separately to complete each of the first panel 11, the second panel 12, the third panel 13, and the fourth panel 14.

Each of the panels 16 include a fastener edge or lock edge 20 defined along one edge, which is shown on a top or upper edge in FIGS. 1-4. A lap edge or butt edge 22 is defined opposite the lock edge 20, and is shown on a bottom or lower edge in FIGS. 1-4. As viewed in the figures, the lock edge 20 is toward the top of each panel 16 (such that the terms upper edge and lock edge 20 are generally interchangeable) and the butt edge 22 is toward the bottom of each panel 16 (such that the terms lower edge and butt edge 22 are generally interchangeable). References to upper and lower directions, regions, or portions are generally defined relative to gravity and, therefore, to the normal flow direction of water or moisture over the panels 16 and the structures to which they are mounted (although wind may cause water to move opposite gravity).

The lock edge 20 contacts the mounting surface 18 and has a plurality of fastener holes 24 defined there through. The fastener holes 24 are configured to mount the panels 16 to the mounting surface 18 with a plurality of fasteners 25 (not shown in all figures), which may include nails, screws, staples, et cetera. In some embodiments, the fastener holes 24 may not be fully defined through the lock edge 20 but may instead be areas designated or identified for piercing by the fasteners 25, such that the fasteners at least partially pierce the material forming the panels 16.

A plurality of raised faces 26 are formed between the lock edge 20 and the butt edge 22. The raised faces 26 shown extend substantially continuously from the lock edge 20 to the butt edge 22 and generally simulate wooden shingles, and have variable widths, as shown in the figures. The raised faces 26 may be designed to represent other decorative units, including shakes, tiles, et cetera.

A plurality of recessed keyways 28 are formed between each of the raised faces 26. The keyways 28 define grooves or channels and link each of the raised faces 26. The keyways 28 are formed from the same substrate material as the raised faces 26 and are recessed from the raised faces 26 toward the mounting surface 18 or the mounting plane that represents the mounting surface 18 to which the panels 16 may subsequently be attached. The keyways 28 may simulate the empty, continuous, horizontal gap between individual wooden shingles in traditional shingle siding.

Note that the second panel 12 may have raised faces 26 of different size, number, or both, relative to the first panel 11. Such that the keyways 28 may be spaced at different intervals on each of the panels 16. Furthermore, even on panels intended to be identical, such as multiple copies of the first panel 11, manufacturing differences or variations may exist. The raised faces 26 and the keyways 28 may have a texture (not shown) that simulates natural wooden shingles. The texture may be formed into the substrate of panels 16, painted onto the substrate, combinations of both, or other techniques.

The keyways 28 are staggered such that they appear to be randomly located, in order to better approximate the aesthetics of natural wooden shingles. The patterns of the keyways 28 vary across a pre-set number of panels 16, which are then assembled onto the mounting surface to approximate wooden shingles. Ideally, the keyways 28 of vertically-adjacent panels 16 never align, irrespective of the order in which the first panel 11, the second panel 12, the third panel 13, the fourth panel 14, and any subsequent panels 16 are assembled, and irrespective of staggering or cut-off lines on the panels 16.

The keyways 28 are located on the various panels 16 based upon a formula or algorithm. Illustrative formulas or algorithms for locating the keyways 28 may be found in U.S. patent application Ser. No. 13/746,133, filed Jan. 21, 2013, the entirety of which is hereby incorporated by reference.

A side lap 30 is formed on the edge of the panels 16. The side lap 30 facilitates horizontal assembly or mating of the panels 16. For example, the second panel 12 may be placed to the right of the first panel 11 and covers at least a portion of the side lap 30 on the first panel 11. In FIG. 2, the side laps 30 are illustrated in dashed lines and show the intersection between the first panel 11 and the second panel 12, and also between the third panel 13 and the fourth panel 14.

Figure 6:
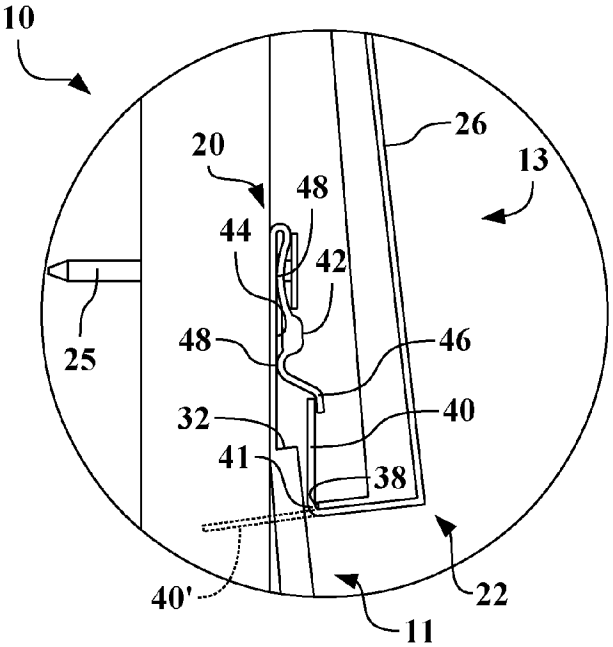
FIG. 6 is a schematic enlarged detail view taken generally along line 6-6 of FIG. 2, and illustrating vertical assembly between a lock edge and a butt edge of the panels.
Figure 5:
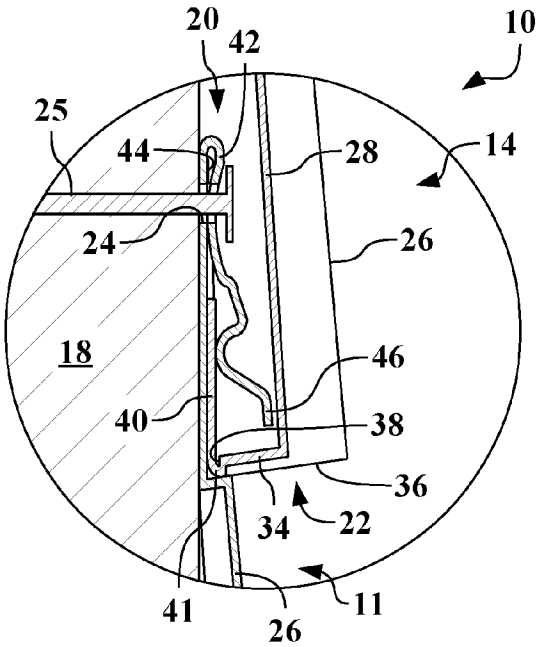
FIG. 5 is a schematic enlarged detail view from area 5 of FIG. 4, illustrating an assembled keyway-lap intersection between the panels.

Referring also to FIG. 5 and to FIG. 6, and with continued reference to FIGS. 1-4, there are shown detail views of junctions or mating regions between vertically-adjacent panels 16. As used herein, references to vertical and horizontal reference to the general directions along the mounting surface 18, such that vertical refers to upward and downward and horizontal refers to leftward and rightward.

FIG. 5 is taken generally from area 5 in FIG. 4 and shows a zoomed or detail view of the intersection between the lock edge 20 of the first panel 11 and the butt edge 22 of the fourth panel 14. FIG. 6 is taken generally from the viewpoint of line 6-6 in FIG. 2 and shows a zoomed or detailed side view of two panels 16 being assembled together, such as the first panel 11 and the third panel 13. FIG. 5 illustrates the interaction between keyways 28 and the lock edges 20 of the panels 16, while FIG. 6 illustrates the interaction between the butt edges 22 and the lock edges 20 at the raised faces 26.

The raised faces 26 define a shoulder 32 adjacent to the lock edge 20. The shoulder 32 is spaced from the mounting surface 18 by a shoulder offset. Furthermore, the shoulder 32 provides an abutment face or surface for interface between the lock edge 20 of one of the panels 16 and the butt edge 22 of another of the panels 16.

As viewed in FIG. 5, the bottom of the keyway 28 includes a recessed base 34 that brings the keyway 28 back toward the mounting surface 18 and defines a rat hole or small gap between the keyway 28 of the upper panel 16 and the shoulder 32 of the lower panel 16 when the two are assembled together. Contrarily, the butt edge 22 adjacent the raised faces 26 extends downward to a full base 36, which directly abuts the shoulder 32, such that there is substantially no gap between the full base 36 and the shoulder 32.

At an interior portion of the keyway 28, toward the mounting surface 18, the recessed base 34 merges with the full base 36, such that the rat hole does not extend to the full possible depth. The recessed base 34 defines a fold point or fold lip 38. The butt edge 22 shown includes an under lap 40, which is used to interface the second panel 12 with the first panel 11.

During manufacturing of the panels 16, many of the features of the panels 16 will be molded, such as through injection molding or vacuum molding. However, some of the features may be post-formed after molding. For example, the under lap 40 may initially be molded substantially planar or coincident with the remainder of the butt edge 22, as illustrated in phantom by an initial under lap 40' in FIG. 4 and FIG. 6. The under lap 40 may then be post-formed to the position shown by folding the initial under lap 40' back toward the remainder of the panel 16.

Each of the keyways 28 defines one fold lip 38 at its recessed base 34—i.e., at each lower, back side portion of the keyways 28. This plurality of fold lips 38 may assist in folding the initial under lap 40' to the final under lap 40 by providing a series of reaction points against which the under lap 40 is folded.

The fold lip 38 and the reaction points or surfaces provided by the fold lip 38 are viewable in both FIGS. 5 and 6. As the recessed base 34 joins with the full base 36, it provides or defines a continuous fold line 41 along the butt edge 22 of the panels 16. The continuous fold line 41 extends along the butt edge 22 regardless of the location of the keyways 28 or raised faces 26. Adjacent the continuous fold line 41—more particularly, above, as viewed in FIGS. 5 and 6—the under lap 40 abuts the fold lip 38, and may come into contact with the fold lip 38, particularly during manufacturing of the panel 16 as the initial under lap 40' is being folded to create the under lap 40. Because the fold lip 38 is offset (upward, as viewed in the figures) from the continuous fold line 41, the under lap 40 cannot be folded further toward the back side of the keyways 28 and is not over folded, which may result in difficulty assembling the under lap 40 to the lock slot 44 of a previous course of panels 16.

The continuous fold line 41 may assist in manufacturing the panel 16 by improving the process of folding the initial under lap 40' from its molded position to its final position, shown as under lap 40 in the figures. If, for example, the recessed base 34 continued without the fold lip 38, there would be a discontinuity at the bottom of each of the keyways 28, which would prevent folding of the under lap 40 along a clean line or plane.

A lock flange 42 is formed on the lock edge 20 and extends away from the mounting surface 18, when the panels 16 are mounted thereto, such that there are two layers of the panels 16 at the lock edge 20. A lock slot 44, or overlap portion, is formed between the layers of the lock edge 20 and is at least partially defined by the lock flange 42. The lock slot 44 opens toward the butt edge 22.

A lock tab 46 is also formed on the lock flange 42 and extends at an angle away from to the mounting surface 18. The lock tab 46 is spaced from the mounting surface 18 by a lock flange offset, which is greater than the gap created by the lock slot 44.

The under lap 40 is configured to slide into the lock slot 44 through the lock tab 46. During installation, the under lap 40 of an upper panel 16 (such as the third panel 13 in FIG. 6) is inserted into the lock slot 44 of a lower panel 16 (such as the first panel 11 in FIG.6) such that the butt edge 22 of the upper panel 16 abuts the shoulder 32 of the lower panel 16, and fasteners 25 may then be inserted though the fastener holes 24 of the upper panel 16 to affix it to the mounting surface 18.

As viewed in FIGS. 5 and 6, the fastener holes 24 pass through the two layers of material forming the lock edge 20 the panels 16, such that each fastener 25 passes through two fastener holes 24. In many configurations, the panels 16 will be manufactured by folding the lock flange 42 to form the lock slot 44 after molding other features of the panel 16, such that the lock flange 42 is initially formed extending upward (as viewed in FIGS. 5 and 6) and then folded to the position shown in the figures. The fastener holes 24 may be formed prior to, or following, the folding operation for the lock flange 42.

As best viewed in FIG. 6, the lock flange 42 closes the lock slot 44 to substantially zero gap or zero depth and creates two touch points 48, at which the two layers of the lock edge 22 of the panels 16 touch. The higher of touch points 48may be referred to as a first touch point 48 and the lower of the touch points 48 may be referred to as a second touch point 48. Note that both touch points 48 being closed to substantially zero gap occurs before any subsequent panel 16 is mated thereto, and that one of the touch points 48 likely opens up as the under lap 40 is inserted into the lock slot 44.

The two touch points 48 may promote both manufacturing and installation functions for the panels 16. During the manufacturing process, folding the lock flange 42 from its initial, extended position to the position shown in the figures creates the touch points 48. Additionally, the touch points 48 provide reduced tolerance concern relative to configurations needing to maintain a specified gap between the layers of the lock edge 20.

Additionally, during installation, the touch points 48 limit the likelihood of an installer driving the fastener 25 so deeply that it closes an otherwise-open gap and prevents or hinders insertion of the under lap 40. Because the lock edge 20 is configured with the first touch point 48 near the fastener holes 24, the lock tab 46 is configured to flex sufficiently to allow insertion of the under lap 40 even with an over-driven fastener. As shown in the figures, the fastener holes 24 are disposed between the top of the lock edge 20 (at the fold beginning the lock flange 42) and the second touch point 48 of the first panel 11.

Assembly or installation of the illustrated siding system 10 may involve side-by-side and bottom-up processes. For example, the first panel 11 may be aligned on the mounting surface 18 and then attached by driving fasteners 25 through the fastener holes 24. The second panel 12 may then be placed to the right or left, as viewed in FIGS. 1 and 2, of the first panel 11 and attached to the mounting surface 18. Therefore, the first panel 11 and the second panel 12 may be part of a first course or first row, which extends generally horizontally from the first panel 11.

A second course of panels may then be placed on the mounting surface 18 above the first course, such that the third panel 13 is aligned above the first panel 11, as viewed in FIGS. 1 and 2. The under lap 40 of the third panel 13 is inserted into the lock slot 44 of the first panel 11 and the butt edge 22 of the second panel 12 is aligned to generally abut the shoulder 32 (the top of the raised faces 26) of the first panel 11. This gives the appearance that the third panel 13 is formed from individual wood shingles laid partially over the top of the simulated wood shingles below (the first panel 11).

Figure 8:
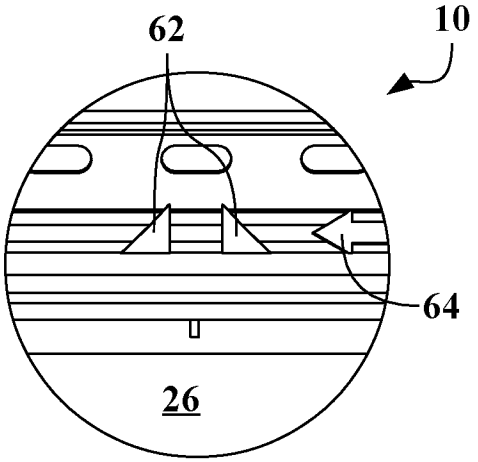
FIG. 8 is a schematic enlarged detail view from area 8 of FIG. 2, illustrating additional installation markings on the panels.
Figure 7:
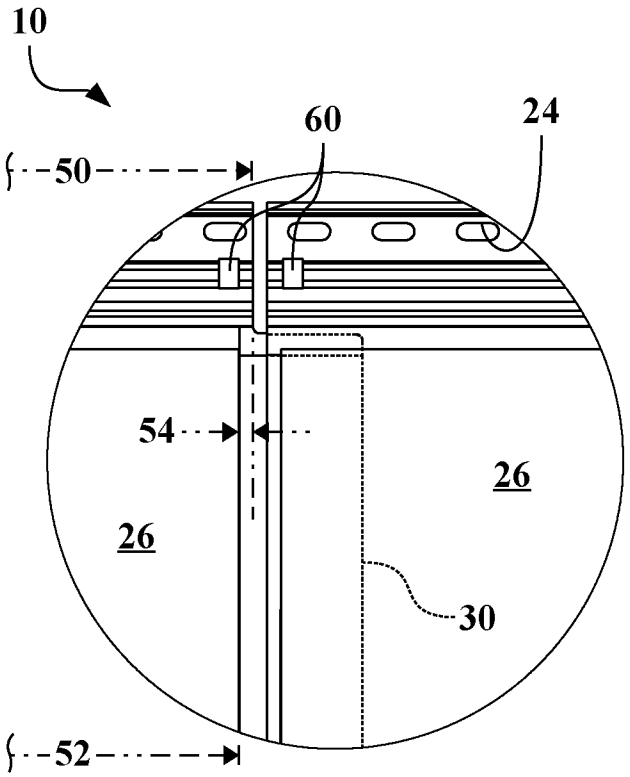
FIG. 7 is a schematic enlarged detail view from area 7 of FIG. 2, illustrating features at the horizontal intersection and installation markings for the panels.

Referring also to FIG. 7 and to FIG. 8, and with continued reference to FIGS. 1-6, there are shown detail views to illustrate horizontal assembly of the panels 16. FIG. 7 shows the side lapping intersection between the third panel 13 and the fourth panel 14, the viewpoint of which is taken generally from detail 7 in FIG. 2. FIG. 8 shows a portion of the panels 16 that may be used as an initial start line, as described herein.

As viewed in FIG. 3 and FIG. 7, the lock edge 20 of the panels 16 spans a distance of a lock width 50, which is measured from the left side (as viewed in the figures) of the panels 16. During assembly, the left side of one panel 16 is overlaid onto the side lap 30 (at the right side) of a previous panel 16, such as shown with the third panel 13 and the fourth panel 14 in FIG. 2 and FIG. 7.

A face width 52 is the distance from the left side of the panel 16, with substantially the same starting point as the lock width 50, to the edge of the last raised face 26 before the side lap 30. As best viewed in FIG. 7, the face width 52 is lesser than the lock width 50, such that the difference between the two defines a minimum key lap 54. The non-zero minimum key lap 54 defines a gap between the body of the panels 16, that provides separation between the keyways 28 and the raised faces 26 of adjacent panels 16.

At the time of initial installation (or repair) of the siding system 10, there will normally be a slight gap between horizontally-adjacent panels 16, as shown in FIG. 7. However, exposure to heat may cause the panels 16 to expand, particularly in the horizontal direction because the panels 16 are longer horizontally than vertically.

When the panels 16 expand, the installation gap between horizontally-adjacent panels 16 may close. In the siding system 10, the lock edges 20 of adjacent panels 16 come into contact before any other portion of the panels 16. In particular, the minimum key lap 54 ensures that no portion of the keyways 28 or the raised faces 26 come into contact prior to contact between the lock edges 20 as a result of heat expansion. The minimum key lap 54 may therefore limit the amount of buckling experienced by the panels 16 under expansion by limiting mid-panel contact of the raised faces 26.

As illustrated in FIGS. 7 and 8, and also in FIG. 2, the panels 16 may also include one or more sets of cut lines or markings to assist in installation of the siding system 10. The first panel 11 may be installed in a single, uncut piece to start the first course (horizontal row) of panels 16. However, as the second course is started, the starting panel 16 in that course will be cut to offset the keyways 28 and provide a more-realistic appearance to the siding system 10. In the example illustrated in FIG. 2, the left portion of the third panel 13 has been removed.

To assist the installer, the panels 16 include a pair of first cut marks 60 and a pair of second cut marks 62, which are different shapes or symbols. On the illustrative panels 16 shown, the first cut marks 60 are a pair of squares or rectangles and the second cut marks 62 are a pair of triangles. The first cut marks 60 are shown in more detail in FIG. 7 and the second cut marks 62 are shown in more detail in FIG. 8. However, the first cut marks 60 and the second cut marks 62 may also be single markings, instead of pairs.

During installation, the installer alternates between starting courses with panels 16 cut at the first cut mark 60 and with panels 16 cut at the second cut mark 62. As viewed in FIGS. 2 and 3, the starting point of the first course is the rectangle symbol of the first cut mark 60 on the first panel 11. Therefore, the starting point of the second course is the triangle symbol of the second cut mark 62 on the third panel 13.

The next course of panels 16, which is not shown, would begin with a panel 16 that has been cut along any of the first cut marks 60 and the portion to the left of the selected first cut marks 60 either discarded or used as the final panel 16 (on the right side, as viewed in the figures) in a subsequent course. Note that the last panels 16 of horizontal courses will be cut to size, with the portion to the right of the cut remaining as leftovers. These portions of the panels 16 may be used to begin subsequent courses by simply trimming the leftover portion at either the first cut marks 60 or the second cut marks 62, depending on the rotation.

As best viewed in FIG. 3, the panels 16 include a number (n) of face elements, which generally represent shingles. On the illustrative panels 16 shown in the figures, there are nine shingles, as defined by the raised faces 26 and the keyways 28 formed therebetween. Therefore, an average element distance or, in the illustrated example of simulated shingle siding, an average shingle distance (ASD) may be defined as the total width (w) of those elements divided by the number of elements. For example, if the panel 16 shown in FIG. 3 were sixty inches long, the average shingle distance would be six and two-thirds inches: ASD=w/n.

Note that the total width may be substantially similar to the lock width 50. The keyways 28, which divide the simulated shingle elements on the panels 16, are placed within specified ranges of the average shingle distances, but do not necessarily coincide with the exact average shingle distance locations.

In the siding system 10, the first cut marks 60 are located at intervals of the average shingle distance and the second cut marks 62 are located at intervals of the one-half of the average shingle distance. More particularly, in the example shown, the first cut marks 60 are located at: 3*ASD, 6*ASD, and 9*ASD, in addition to the initial mark at the far left, or 0*ASD. Similarly, in the example shown, the second cut marks 62 are located at: 1.5*ASD, 4.5*ASD, and 7.5*ASD.

As shown in FIG. 8, and also viewable in FIGS. 2 and 3, the panels 16 may also contain one or more third marks 64. In the illustrative panel 16 shown, the third mark 64 is an arrow symbol. Regardless of the start point (or start marking) for a horizontal course of the panels 16, the side lap 30 of each installed panel 16 will align with one of the third marks 64 on the panel 16 in the course immediately below. The location of the third marks 64 helps the installer verify that the panels 16 of each subsequent course have been properly installed.

For example, if the installer began two consecutive courses (horizontal rows) by cutting both of the starting panels 16 at the second cut marks 62, the side laps 30 of each of the panels 16 of the upper course would not align with any of the third marks 64 on the lower course. Each of these misalignments would alert the installer to an installation error, because every panel on the incorrect course would not align with one of the third marks 64 below. Furthermore, the installer would be visually alerted while the erroneous course—due to an improper starting cut—was still in progress, which limits the amount of waste and repair time.

Figure 10:
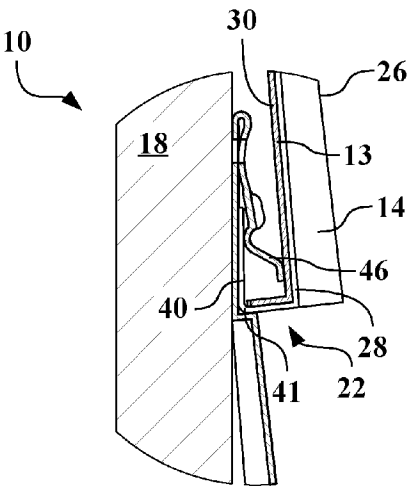
FIG. 10 is a schematic enlarged detail cross-sectional view taken generally along line 10-10 of FIG. 2, illustrating a side lap of one of the panels.
Figure 9:
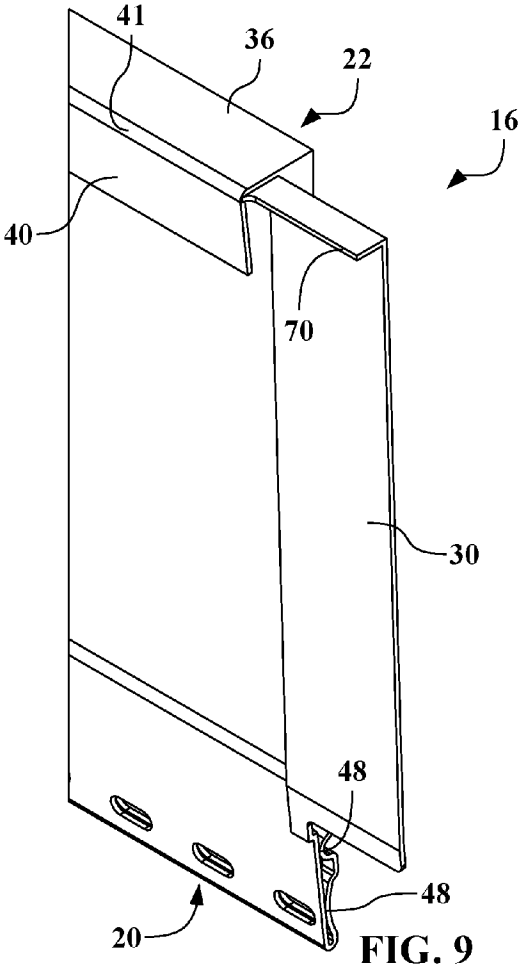
FIG. 9 is a schematic isometric view of a side lap of one of the panels.

Referring also to FIG. 9 and to FIG. 10, and with continued reference to FIGS. 1-8, there are shown detail views to illustrate horizontal assembly and interaction of the side lap 30 with adjacent panels 16. FIG. 9 shows an isometric view of the lower rear side of the panel 16. FIG. 10 shows a detail view taken generally from line 10-10 in FIG. 2.

As illustrated in FIG. 9, the side lap 30 extends outward from the end of the panel 16. Much of the side lap 30 emulates the keyways 28. However, the side lap 30 does not include the fold point 38. Furthermore, the side lap 30 includes a side lap cut 70 instead of continuing the under lap 40 from the remainder of the panel 16. The side lap cut 70 provides relief or space for the under lap 40 of the subsequent panel 16 assembled over the side lap 30.

The viewpoint of FIG. 10 is taken from immediately adjacent to the fourth panel 14, and shows its interaction with the third panel 13 and the first panel 11, both of which are sectioned by the view. As illustrated in FIG. 10, the side lap 30 of the third panel 13 is nested within the butt edge 22 of the fourth panel 14. More particularly, the under lap 40 of the fourth panel 14 wraps around the side lap 30 of the third panel 30.

The detailed description and the drawings or figures are supportive and descriptive of the invention, but the scope of the invention is defined solely by the claims. While some of the best modes and other embodiments for carrying out the described processes and products have been discussed in detail, various alternative designs, configurations, and embodiments exist.

The invention claimed is:

1. A panel configured for attachment to a mounting surface, comprising:

a plurality of raised faces formed and extending between a lock edge and a butt edge of the panel;

a plurality of recessed keyways defined between each of the raised faces, such that the raised faces and the keyways define a plurality of elements spaced at an average element distance;

a recessed base formed at the keyways adjacent the butt edge, wherein the recessed base defines a fold lip adjacent the mounting surface;

a full base formed at the raised faces adjacent the butt edge, wherein the full base extends further than the recessed base, and the fold lip joins the recessed base to the full base to define a continuous fold line; and an under lap extending from the full base toward the lock edge, wherein the fold lip is configured to provide a reaction point for the under lap, and the reaction point is offset from the continuous fold line such that the under lap is overlapping the fold lip.

2. The panel of claim 1, wherein the under lap abuts the fold lip.

3. The panel of claim 2, wherein the lock edge of the panel spans a distance of a lock width and the raised faces of the panel span a distance of a face width, and wherein the face width is less than the lock width.

4. The panel of claim 3, further comprising:

a lock flange formed at the lock edge and defining a lock slot between layers of the panel, wherein the lock flange closes the lock slot to substantially zero depth at a first touch point and a second touch point.

5. The panel of claim 4, further comprising:

a first cut marking formed on the lock edge of the panel, wherein the first cut marking is located at a multiple of the average element distance; and a second cut marking formed on the lock edge of the panel, wherein the second cut marking is located at a multiple of one-half of the average element distance.

6. The panel of claim 5, further comprising:

a third cut marking formed on the lock edge of the panel, wherein the third cut marking is located at a multiple of one-half of the average element distance.

7. The panel of claim 1, further comprising:

a lock flange formed at the lock edge and defining a lock slot between layers of the panel, wherein the lock flange closes the lock slot to substantially zero depth at a first touch point and a second touch point.

8. The panel of claim 1, further comprising:

a first cut marking formed on the lock edge of the panel, wherein the first cut marking is located at a multiple of the average element distance;

a second cut marking formed on the lock edge of the panel, wherein the second cut marking is located at a multiple of one-half of the average element distance; and a third cut marking formed on the lock edge of the panel, wherein the third cut marking is located at a multiple of one-half of the average element distance.

9. A panel configured for attachment to a mounting surface, comprising:

a plurality of raised faces formed between a lock edge and a butt edge of the panel;

a plurality of recessed keyways defined between each of the raised faces, wherein the raised faces and the keyways define a plurality of elements spaced at an average element distance;

a lock flange formed at the lock edge and defining a lock slot between layers of the panel, wherein the lock flange closes the lock slot to substantially zero depth at a first touch point and a second touch point;

a recessed base formed at the keyways adjacent the butt edge, wherein the recessed base defines a fold lip adjacent the mounting surface;

a full base formed at the raised faces adjacent the butt edge, wherein the full base extends further than the recessed base, and the fold lip joins the recessed base to the full base to define a continuous fold line; and an under lap extending from the full base toward the lock edge, wherein the fold lip is configured to provide a reaction point for the under lap, and the reaction point is offset from the continuous fold line such that the under lap is overlapping the fold lip.

10. The panel of claim 9, further comprising:

a fastener hole defined through the lock flange, wherein the fastener hole is disposed between a top of the lock edge and one of the first touch point and the second touch point.

11. The panel of claim 10, further comprising:

a first cut marking formed on the lock edge of the panel, wherein the first cut marking is located at a multiple of the average element distance; and a second cut marking formed on the lock edge of the panel, wherein the second cut marking is located at a multiple of one-half of the average element distance.

12. The panel of claim 11, further comprising:

a third cut marking formed on the lock edge of the panel, wherein the third cut marking is located at a multiple of one-half of the average element distance.

13. The panel of claim 12, wherein the lock edge of the panel spans a distance of a lock width and the raised faces of the panel span a distance of a face width, and wherein the face width is less than the lock width.

* * * * *